US012415109B1

(12) United States Patent
Wang

(10) Patent No.: US 12,415,109 B1
(45) Date of Patent: Sep. 16, 2025

(54) FOLDABLE SMALL FLYING AND SQUAT RACK

(71) Applicant: Wall Home Inc, Denver, CO (US)

(72) Inventor: Ruibo Wang, Denver, CO (US)

( * ) Notice: Subject to any disclaimer, the term of this patent is extended or adjusted under 35 U.S.C. 154(b) by 0 days.

(21) Appl. No.: 19/016,758

(22) Filed: Jan. 10, 2025

(51) Int. Cl.
*A63B 21/00* (2006.01)
*A63B 23/04* (2006.01)
*A63B 23/12* (2006.01)

(52) U.S. Cl.
CPC ..... *A63B 21/154* (2013.01); *A63B 21/00069* (2013.01); *A63B 23/1254* (2013.01); *A63B 2023/0411* (2013.01); *A63B 2210/50* (2013.01); *A63B 2225/10* (2013.01)

(58) Field of Classification Search
CPC ..... A63B 21/154; A63B 21/00069; A63B 23/1254; A63B 2023/0411; A63B 2210/50; A63B 2225/10
See application file for complete search history.

(56) References Cited

U.S. PATENT DOCUMENTS 4,898,381 A * 2/1990 Gordon ..... A63B 23/03533 482/103
6,379,287 B1 * 4/2002 Slawinski ..... A63B 21/0783 482/4
7,488,277 B1 * 2/2009 Knapp ..... A63B 21/0626 482/106
10,350,445 B2 * 7/2019 Hockridge ..... A63B 23/03541
11,524,201 B2 * 12/2022 Gore ..... A63B 21/4035
12,011,635 B1 * 6/2024 Xiao ..... A63B 21/0724
12,059,587 B2 * 8/2024 Gore ..... A63B 21/0783
2002/0091043 A1 * 7/2002 Rexach ..... A63B 21/0628 482/99
2008/0287270 A1 * 11/2008 Carter ..... A63B 23/12 482/99
2020/0155889 A1 * 5/2020 Leipheimer ..... A63B 21/156
2020/0384337 A1 * 12/2020 Brasch ..... A63B 23/1218

FOREIGN PATENT DOCUMENTS

CN 114699714 A * 7/2022

* cited by examiner

*Primary Examiner* — Andrew S Lo
(74) *Attorney, Agent, or Firm* — Hawaii Patent Services; Nathaniel K. Fedde; Kenton N. Fedde

(57) ABSTRACT

The present disclosure provides a foldable small flying and squat rack, which comprises a fixed rack, a pivot rack and pulley blocks disposed on the fixed rack and the pivot rack, wherein the pivot rack can rotate relative to the fixed rack, a counterweight assembly is disposed at the lower part of the fixed rack, and a connecting rope is connected at the upper part of the counterweight assembly; the connecting rope winds around the pulley blocks on the fixed rack and the pivot rack in turn to extend out, and then passes through a flying guide wheel to be connected to a grip part.

20 Claims, 9 Drawing Sheets

FOLDABLE SMALL FLYING AND SQUAT RACK

TECHNICAL FIELD

The present disclosure relates to the technical field of sports equipment, in particular to a foldable small flying and squat rack.

BACKGROUND

Smith machine and big and small flying exercisers are two kinds of fitness equipment that must be equipped in the exercise field and gym. However, having these two exercisers at the same time is too expensive and takes up too much space, which is not suitable for use in places with limited space such as home.

Although there are comprehensive exercisers combining Smith machine and small flying exerciser in the market, Smith machine and small flying exerciser are simply superimposed and combined together, and they do not have the function of mutual conversion. For this kind of machines, since they include all the necessary components of Smith machine and small flying exerciser, the manufacturing cost is not less than that of two separate machines, and they are huge.

A "Slidable bar and carriage exercise assembly" is known in the art, which includes a Smith bar as a part of multifunctional exerciser, and uses Smith bar instead of free weight to use optional weight stacking to resist movement resistance; U.S. patent Ser. No. 12/011,635 puts forward "Multifunctional comprehensive training device capable of being grasped stably", which enables the same set of selected barbells to be used for Smith mechanism and cable mechanism by racks, hangers and other parts.

However, when the exerciser disclosed above is adjusted in angle and folded for storage, the rotation of the pivot rack often involves the pull rope and then pulls the load-bearing assembly, which increases the rotation resistance of the pivot rack.

SUMMARY

In order to solve the shortcomings of the prior art, the present disclosure provides a foldable small flying and squat rack, which includes a fixed rack, pivot racks and pulley blocks disposed on the fixed rack and the pivot rack, wherein there two pivot racks that are respectively rotatably connected to the fixed rack; and a lower part of the fixed rack is provided with a counterweight assembly, which is connected with the fixed rack in a sliding manner, and an upper part of the counterweight assembly is connected with a connecting rope, which winds around the pulley blocks on the fixed rack and the pivot racks in turn to extend out; and each of the two pivot racks is provided with a pivot wheel set mechanism, and a connecting sheet is fixedly disposed on the pivot wheel set mechanism; and a rotary inner cylinder is fixedly disposed on the connecting sheet, and the pivot racks are rotatably connected with the fixed rack through the rotary inner cylinder; and the connecting rope passes through the rotary inner cylinder, and the pulley block includes a first deflecting pulley and a second deflecting pulley, which are respectively disposed above and below the rotary inner cylinder; and wherein, a part of the connecting rope located at the position of a rotating axis of the rotary inner cylinder is always in a vertical state, and a tangent point of the connecting rope winding out of the first deflecting pulley and into the second deflecting pulley is located on the axis of the rotary inner cylinder, so as to avoid the connecting rope from being dragged by the rotation of the pivot rack.

At the same time, the present disclosure provides a foldable small flying and squat rack, which includes a fixed rack, pivot racks and pulley blocks disposed on the fixed rack and the pivot rack, wherein there are two pivot racks that are respectively connected to the fixed rack; and a lower part of the fixed rack is provided with a counterweight assembly, which is connected with the fixed rack in a sliding manner, and an upper part of the counterweight assembly is connected with a connecting rope, which winds around the pulley blocks on the fixed rack and the pivot racks in turn to extend out; and each of the two pivot racks is provided with a pivot wheel set mechanism, and a connecting sheet is fixedly disposed on the pivot wheel set mechanism; and a rotary inner cylinder is fixedly disposed on the connecting sheet, the two pivot racks are rotatably connected with the fixed rack respectively through the rotary inner cylinder and rotate to any angle within a limited angle range; and the connecting rope passes through the rotary inner cylinder, and the pulley block includes a first deflecting pulley and a second deflecting pulley, which are respectively disposed above and below the rotary inner cylinder; and wherein, a part of the connecting rope located at the position of a rotating axis of the rotary inner cylinder is always in a vertical state, and a tangent point of the connecting rope winding out of the first deflecting pulley and into the second deflecting pulley is located on the axis of the rotary inner cylinder, so as to avoid the connecting rope from being dragged by the rotation of the pivot rack.

At the same time, the present disclosure also provides a foldable small flying and squat rack, which includes a fixed rack, pivot racks and pulley blocks disposed on the fixed rack and the pivot rack, wherein there are two pivot racks that are respectively connected to the fixed rack; and a lower part of the fixed rack is provided with a counterweight assembly, which is connected with the fixed rack in a sliding manner, and an upper part of the counterweight assembly is connected with a connecting rope, which winds around the pulley blocks on the fixed rack and the pivot racks in turn to extend out; and each of the two pivot racks is provided with a pivot wheel set mechanism, and a connecting sheet is fixedly disposed on the pivot wheel set mechanism; and a rotary inner cylinder is fixedly disposed on the connecting sheet, the two pivot racks are rotatably connected with the fixed rack respectively through the rotary inner cylinder; and the pulley block includes a first deflecting pulley and a second deflecting pulley; the first deflecting pulley is disposed above the rotary inner cylinder, and the second deflecting pulley is disposed below the rotary inner cylinder;

wherein, the connecting rope winds out of the first deflecting pulley, passes through the rotary inner cylinder and winds into the second deflecting pulley; and the connecting rope in the rotary inner cylinder is always kept in a vertical state, so as to avoid the connecting rope from being dragged by the rotation of the pivot rack.

BRIEF DESCRIPTION OF DRAWINGS

In order to explain the technical solution of this application more clearly, the drawings needed in the implementation will be briefly introduced below. Obviously, the drawings described below are only some implementations of this application. For those skilled in the art, other drawings can be obtained according to these drawings without creative work.

REFERENCE SIGNS

Figure 1:
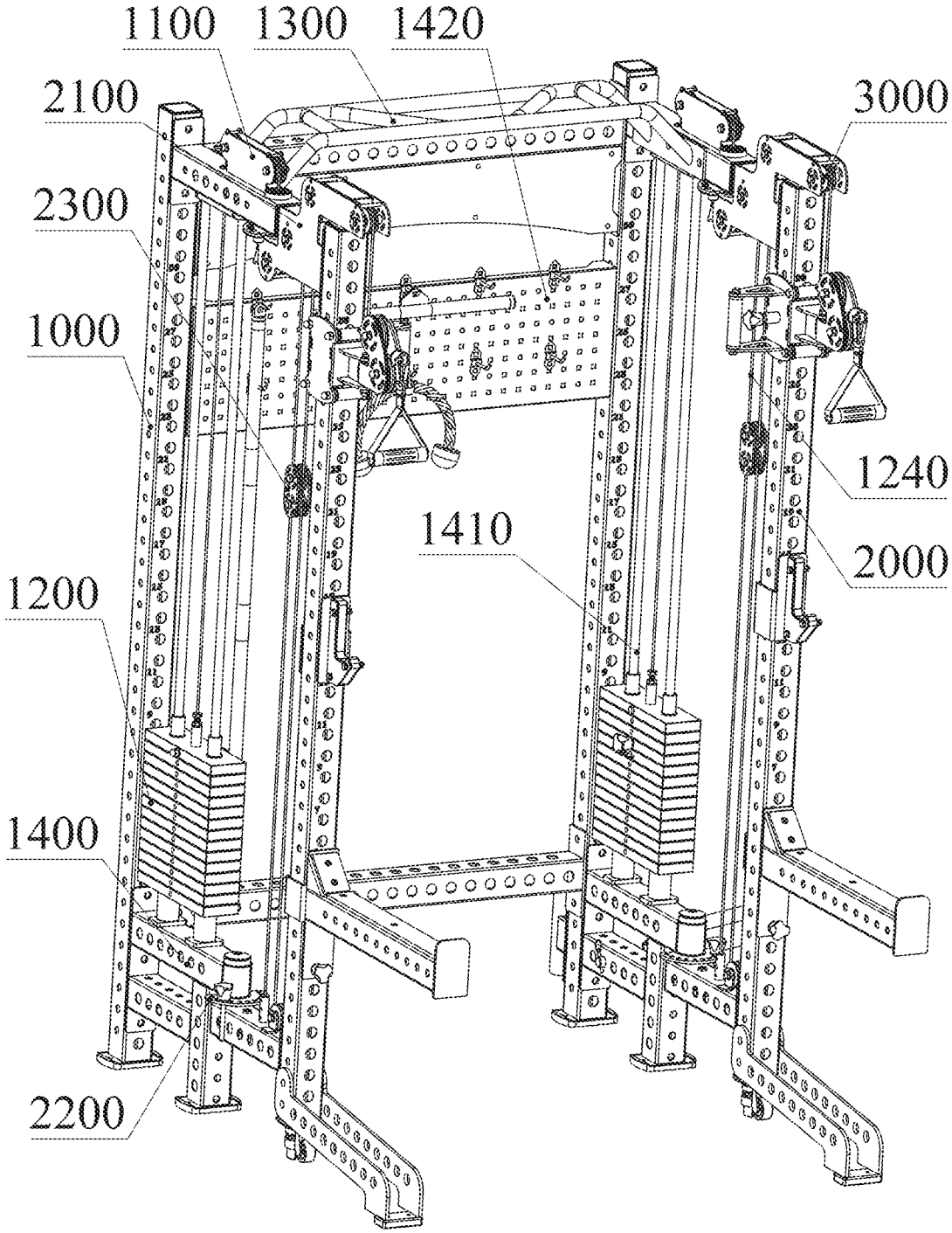
FIG. 1 is a first perspective schematic view of a foldable small flying and a squat rack.

1000, Fixed rack; 1100, Fixed wheel carrier; 1200, Counterweight assembly; 1210, Weight stack; 1211, Yielding hole; 1212, Adjusting hole; 1220, Adjusting rod; 1221, Matching hole; 1230, Adjusting pin; 1240, Connecting rope; 1300, Pull-up assembly; 1310, Fixed plate; 1320, Fixed tube; 1330, Vertical rod; 1340, Inclined rod; 1400, Chassis; 1410, Counterweight slidable bar; 1420, Storage plate; 1421, Hook; 2000, Pivot rack; 2100, Pivot wheel set mechanism; 2110, Connecting sheet; 2111, Rotary inner cylinder; 2120, Pivot wheel rack; 2200, Hole plate fixing mechanism; 2210, First spring bolt; 2220, Upper rotary sleeve; 2230, Upper fixed hole plate; 2231, Upper insertion hole; 2240, Upper pivot bearing; 2250, Lower rotary sleeve; 2251, circular cover plate; 2260, Rotary column; 2270, Lower pivot bearing; 2280, Lower fixed hole plate; 2281, Lower insertion hole; 2282, Fixed pin; 2283, Positioning hole; 2300, Adjusting wheel set mechanism; 2310, Crown block; 2320, Movable pulley block; 2321, Sliding rack; 2322, Upper sliding wheel; 2323, Lower sliding wheel; 2410, Flying carriage; 2420, Flying wheel carrier; 2421, Wheel carrier shaft; 2430, Flying guide wheel; 2440, Grip part; 2450, Adjusting rope; 2460, Carriage rack; 2461, Handle; 2462, Preset hole; 2470, Second spring bolt; 3000, Pulley block; 3101, First pivot wheel; 3102, Second pivot wheel; 3103, Third pivot wheel; 3104, Fourth pivot wheel; 3105, Fixed wheel.

DESCRIPTION OF EMBODIMENTS

The technical solution in the embodiment of the application will be clearly and completely described below with reference to the drawings in the embodiment of the application. Obviously, the described embodiment is only part of, rather than all of the embodiments of the application. Based on the embodiments in this application, all other embodiments obtained by those skilled in the art without creative labor belong to the protection scope of this application.

Reference to "an example" or "an embodiment" herein means that a particular feature, structure or characteristic described in connection with an example or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, which is only for the convenience of describing this specification and simplifying the description, and does not indicate or imply that the referred devices or elements must have a specific orientation, be constructed and operated in a specific orientation, so it cannot be understood as a limitation of this disclosure. The positional relationship of the constituent elements is appropriately changed according to the direction of the described constituent elements. Therefore, it is not limited to the words and expressions described in the specification, and can be replaced appropriately according to the situation.

Figure 2:
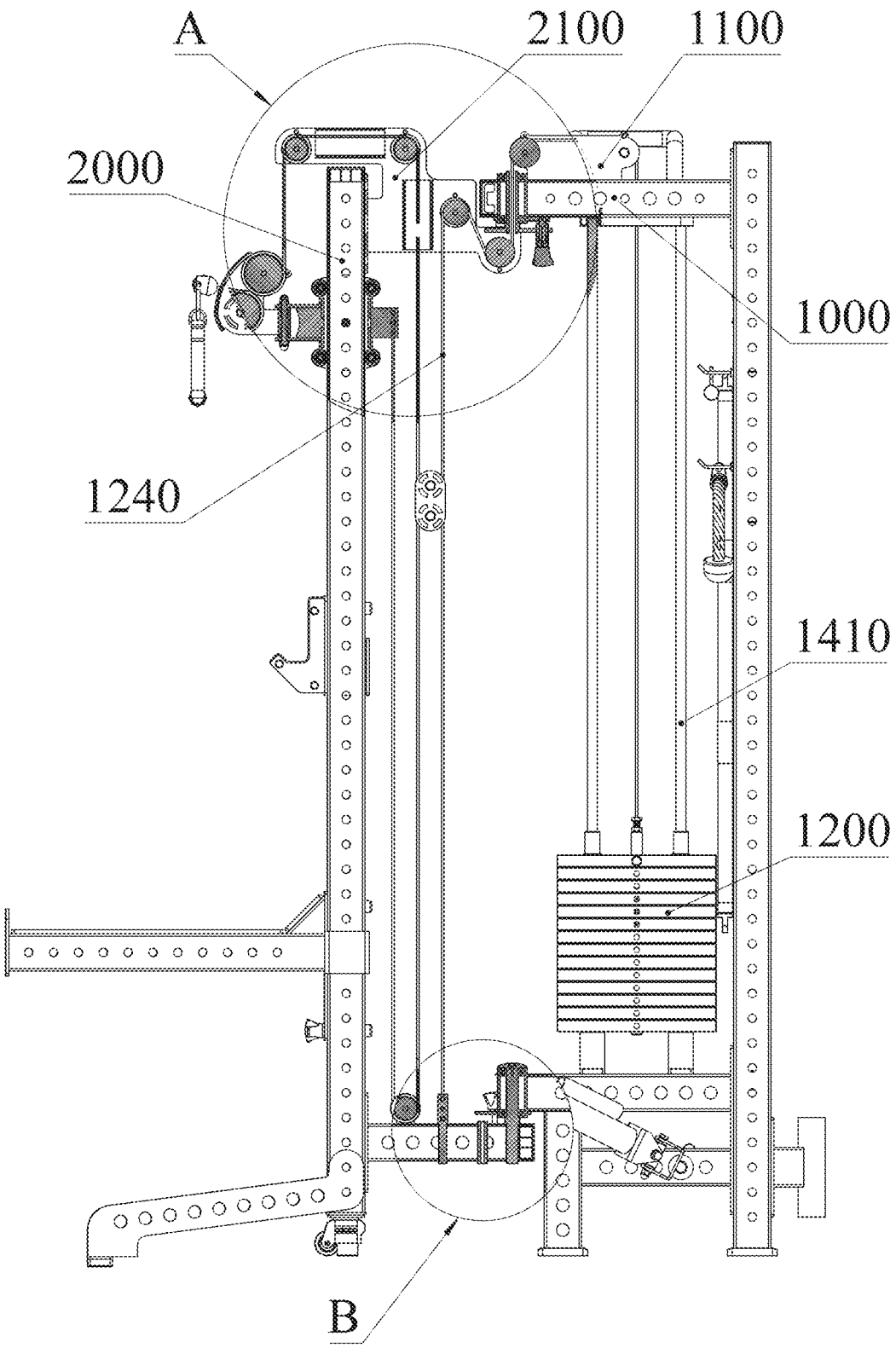
FIG. 2 is a schematic right view of the foldable small flying and squat rack.

As shown in FIGS. 1 and 2, the present disclosure provides a foldable small flying and squat rack, which includes a fixed rack 1000, two pivot racks 2000, and pulley blocks 3000 disposed on the fixed rack 1000 and the pivot racks 2000.

Specifically, the pivot racks 2000 are rotatably connected to both sides of the fixed rack 1000, and the pivot racks 2000 are symmetrically disposed about the fixed rack 1000. In order to meet the diversified training needs of users, a counterweight assembly 1200 is disposed at the lower part of the fixed rack 1000, and a connecting rope 1240 is connected at the upper part of the counterweight assembly 1200, which sequentially winds around pulley blocks 3000 on the fixed rack 1000 and the pivot racks 2000 to extend out to ensure that the connecting rope 1240 transmits the lifting force to the counterweight assembly 1200.

Figure 3:
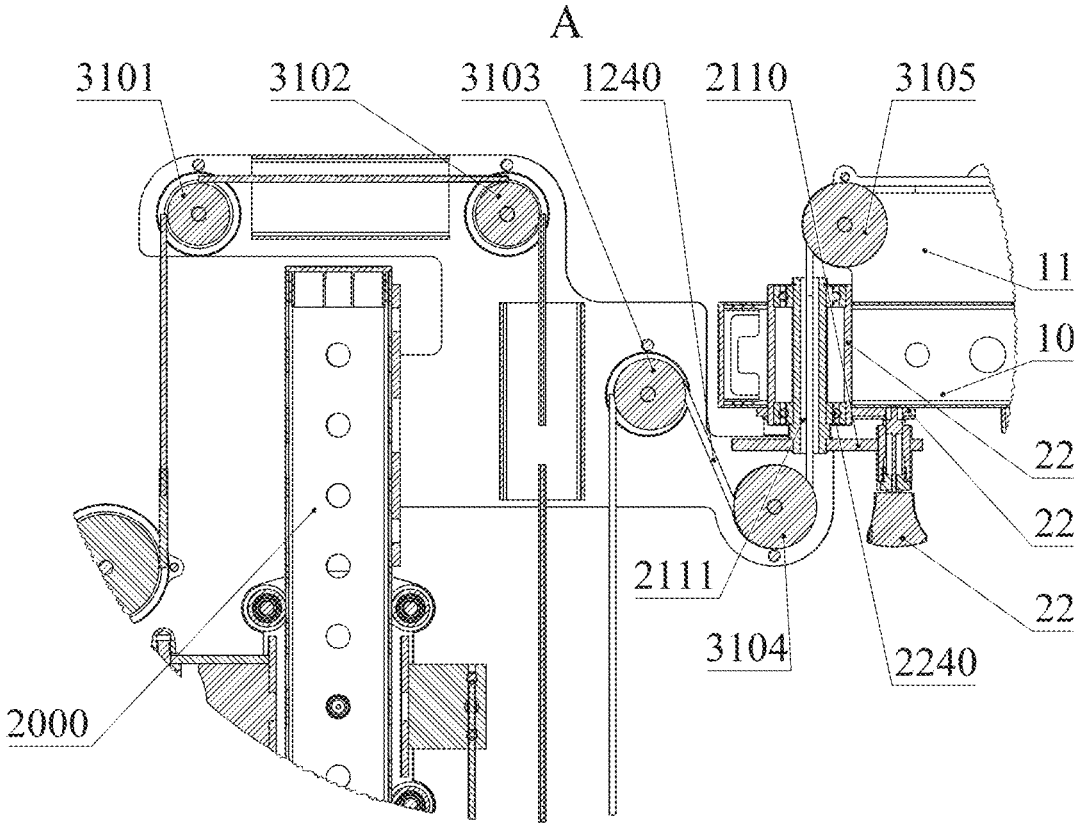
FIG. 3 is a partial cross-sectional view at A of FIG. 2.

As shown in FIG. 2 and FIG. 3, the pivot rack 2000 is provided with a pivot wheel set mechanism 2100, and a connecting sheet 2110 is fixedly disposed on the pivot wheel set mechanism 2100. A rotary inner cylinder 2111 is fixedly disposed on the connecting sheet 2110, so that the pivot rack 2000 can be rotationally connected with the fixed rack 1000 by the rotary inner cylinder 2111. The connecting rope 1240 passes through the rotary inner cylinder 2111, and the pivot rack 2000 can horizontally rotate to any position within a limited angle range to rotate to a normal open state, a storage state or an expanded state.

In order to ensure that the connecting rope 1240 is not dragged by the rotation of the pivot rack 2000, the pulley block 3000 is provided with a first deflecting pulley and a second deflecting pulley, which are respectively disposed above and below the rotary inner cylinder 2111. Furthermore, when the connecting rope 1240 winds out of the first deflecting pulley and the second deflecting pulley, it is preferable that the connecting rope 1240 coincides with the rotating axis of the rotary inner cylinder 2111. Even if the pivot rack 2000 rotates around the rotary inner cylinder 2111, the part of the connecting rope 1240 located at the rotating axis of the rotary inner cylinder 2111 always remains vertical. Thus, although the connecting rope 1240 has torsional shear stress between the first deflecting pulley and the second deflecting pulley, it does not affect the lifting force on the counterweight assembly 1200 connected at the end of the connecting rope 1240, which ensures that when the connecting rope 1240 is in the abnormal opening state of the pivot racks 2000, the counterweight assembly 1200 is lifted due to the pulling force. In other embodiments of the connecting rope 1240 (not shown), the connecting rope 1240 does not need to coincide with the axis of the rotary inner cylinder 2111, but only needs to be parallel to the axis of the rotary inner cylinder 2111, and the connecting rope 1240 does not touch the inner wall of the rotary inner cylinder 2111, which means that the connecting rope 1240 is offset by a certain distance relative to the axis of the rotary inner cylinder 2111, thus ensuring the normal operation of the connecting rope 1240.

In order to ensure the transmission of the lifting force of the connecting rope 1240, the pivot wheel set mechanism 2100 further includes a pivot wheel rack 2120 fixedly connected to the top of the pivot rack 2000. The first pivot wheel 3101, the second pivot wheel 3102, the third pivot wheel 3103 and the fourth pivot wheel 3104 in the pulley block 3000 are disposed on the pivot wheel rack 2120. The first pivot wheel 3101 is located at the side of the pivot rack 2000 far from the fixed rack 1000, while the second pivot wheel 3102, the third pivot wheel 3103 and the fourth pivot wheel 3104 are located at one side of the pivot rack 2000 near the fixed rack 1000. The connecting rope 1240 passes through the fourth pivot wheel 3104, the third pivot wheel 3103, the second pivot wheel 3102 and the first pivot wheel 3101 in turn, wherein the fourth pivot wheel 3104 is disposed below the rotary inner cylinder 2111 to constitute the second deflecting pulley.

As shown in FIG. 3, both sides of the upper part of the fixed rack 1000 are provided with fixed wheel carriers 1100, each fixed wheel carrier 1100 is rotatably connected with two fixed wheels 3105, and the fixed wheel 3105 close to the pivot rack 2000 is disposed above the rotary inner cylinder 2111 to constitute the first deflecting pulley.

Figure 4:
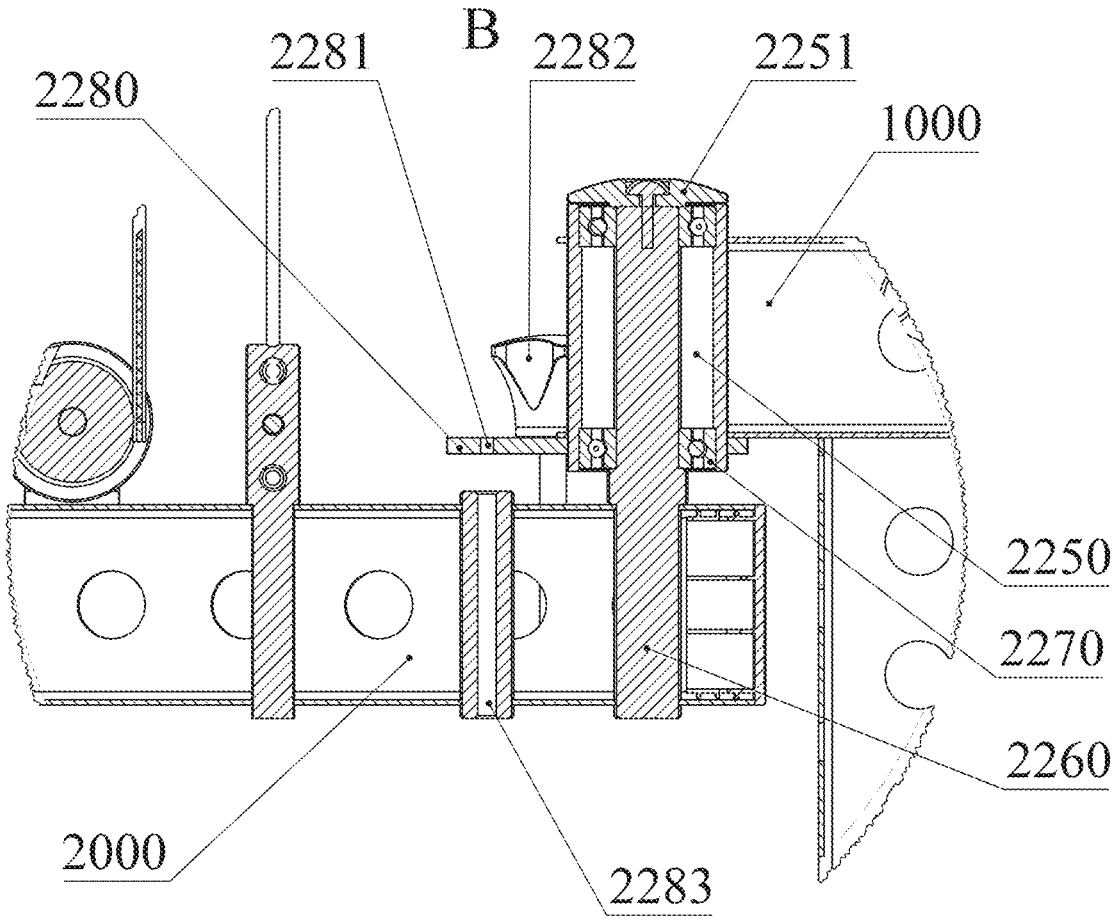
FIG. 4 is a partial cross-sectional view at B in FIG. 2.
Figure 5:
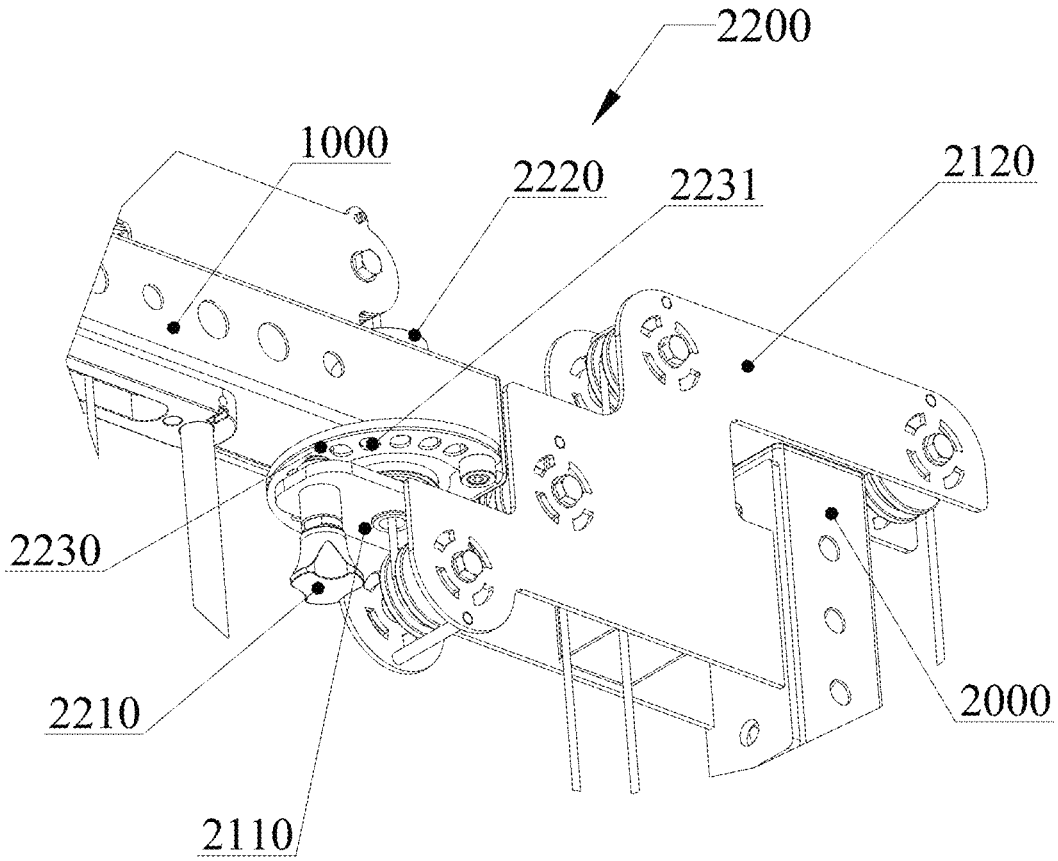
FIG. 5 is a partial schematic view of the hole plate fixing mechanism.

As shown in FIG. 4 and FIG. 5, in order to provide a selectin for the rotation angle of the pivot rack 2000, a hole plate fixing mechanism 2200 for limiting the rotation of the pivot rack 2000 is disposed between the pivot rack 2000 and the fixed rack 1000. A first spring bolt 2210 is also disposed on the connecting sheet 2110. The hole plate fixing mechanism 2200 includes an upper rotary sleeve 2220 fixedly connected with the upper part of the fixed rack 1000. The rotary inner cylinder 2111 and the upper rotary sleeve 2220 are rotatably connected, and the upper rotary sleeve 2220 is fixedly connected with an upper fixed hole plate 2230, which is provided with a plurality of upper insertion holes 2231, wherein the first spring pin 2210 is inserted into the upper insertion hole 2231 to fix the position of the connecting sheet 2110 relative to the upper fixed hole plate 2230, and the axes of the upper rotary sleeve 2220 and the rotary inner cylinder 2111 are perpendicular to the ground. A plurality of upper pivot bearings 2240 are disposed between the upper rotary sleeve 2220 and the rotary inner cylinder 2111. The upper rotary sleeve 2220 and the rotary inner cylinder 2111 are hollow, and the connecting rope 1240 passes through the rotary inner cylinder 2111. When the angle of the pivot rack 2000 needs to be changed, the user can partially pull out the first spring bolt 2210 first, so that the first spring bolt 2210 is separated from the upper insertion hole 2231. The user rotates the pivot rack 2000 to a proper position, and then loosens his grip, and the first spring bolt 2210 will automatically rebound to be inserted into the insertion hole 2231 on the upper fixed hole plate 2230 to achieve locking.

As shown in FIG. 4, the hole plate fixing mechanism 2200 further includes a lower rotary sleeve 2250 fixedly connected with the lower part of the fixed rack 1000, a rotary column 2260 is disposed below the pivot rack 2000, and a plurality of lower pivot bearings 2270 are disposed between the lower rotary sleeve 2250 and the rotary column 2260. In order to ensure that the pivot rack 2000 is firmly fixed, the rotating shafts of the upper rotary sleeve 2220 and the lower rotary sleeve 2250 coincide and are perpendicular to the ground.

As shown in FIG. 4, in order to further ensure the stable rotation and firm fixation of the pivot rack 2000, a lower fixed hole plate 2280 is fixedly disposed below the lower rotary sleeve 2250, and a plurality of lower insertion holes 2281 are disposed on the lower fixed hole plate 2280. A positioning hole 2283 is disposed on the pivot rack 2000, and a fixed pin 2282 is inserted into the lower insertion hole 2281. The fixed pin 2282 can be inserted into the positioning hole 2283 to fix the position of the lower fixed hole plate 2280 relative to the pivot rack 2000. The top of the lower rotary sleeve 2250 is provided with a circular cover plate 2251, which is fixedly connected with the rotary column 2260 by bolts. The use method of the fixed pin 2282 is the same as that of the first spring bolt 2210, and they jointly play the role of fixing the pivot rack 2000.

Figure 6:
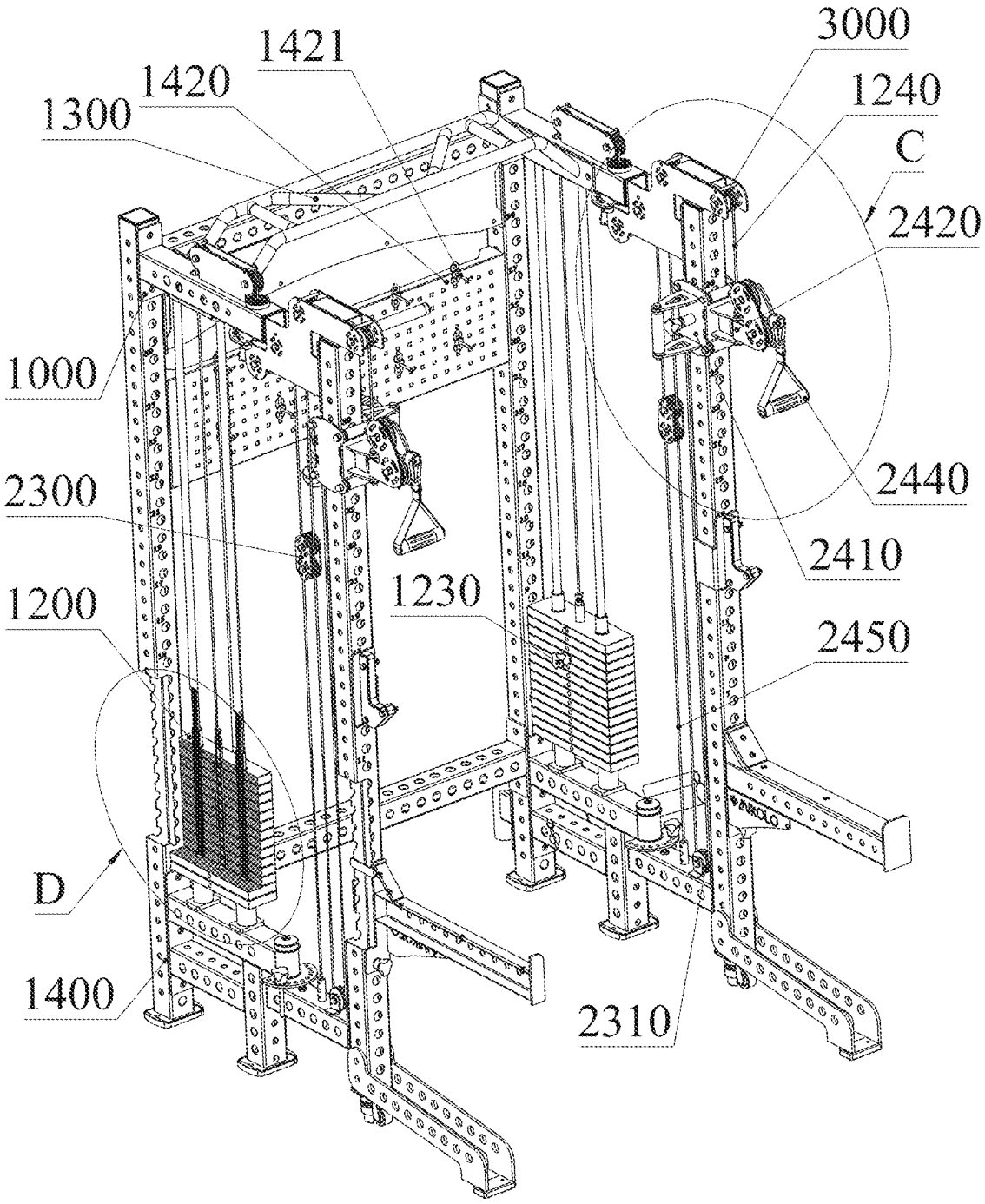
FIG. 6 is a second perspective view of the foldable small flying and squat rack.
Figure 7:
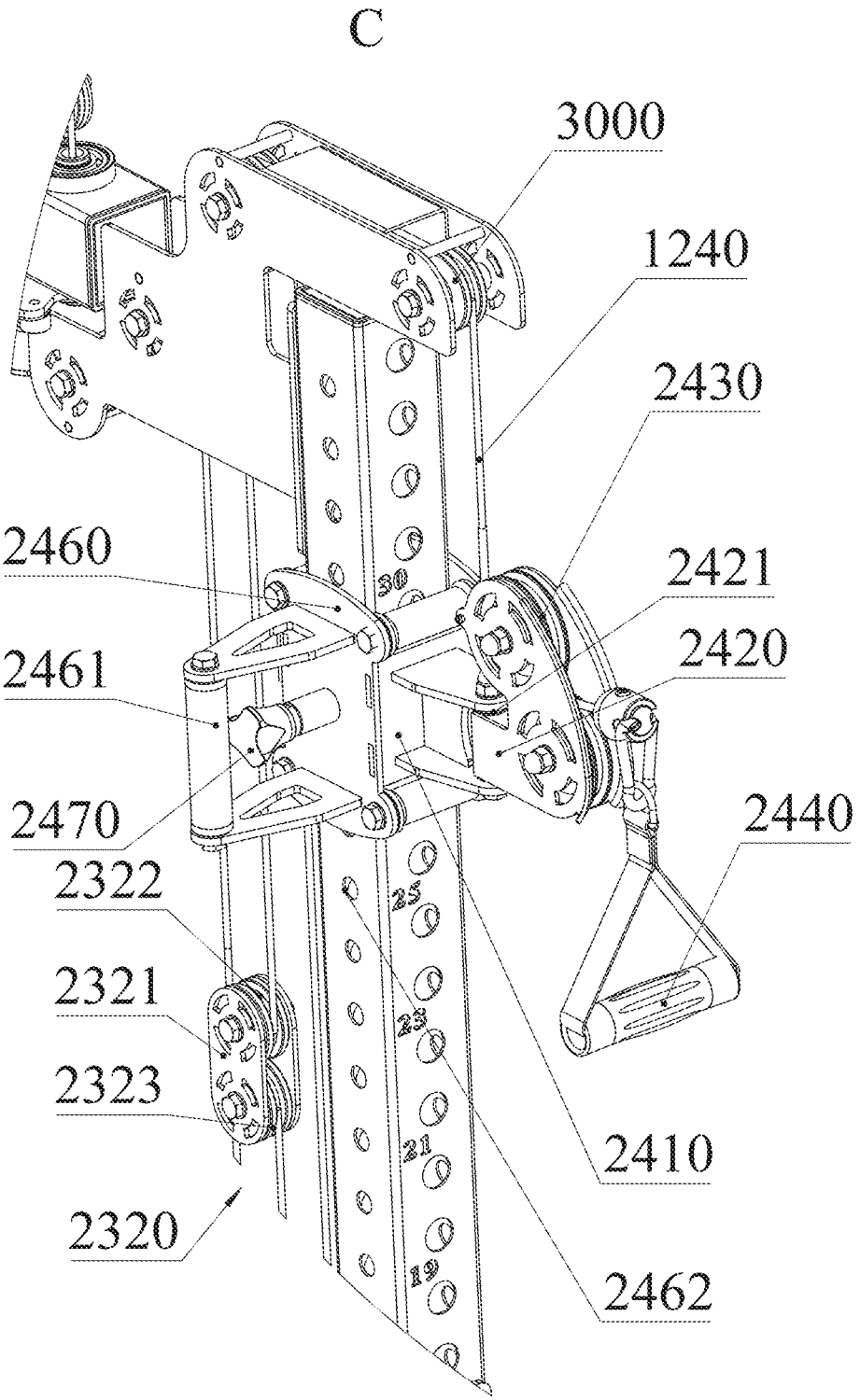
FIG. 7 is a partial schematic view at C in FIG. 6.

As shown in FIGS. 6 and 7, both pivot racks 2000 are provided with adjusting wheel set mechanisms 2300. The adjusting wheel set mechanism 2300 includes a crown block 2310 and a movable pulley set 2320. The crown block 2310 is rotatably connected with the bottom of the pivot rack 2000, and the movable pulley set 2320 is located in the middle of the pivot rack 2000. The movable pulley block 2320 includes a sliding rack 2321, and an upper sliding wheel 2322 and a lower sliding wheel 2323 rotatably connected with the sliding rack 2321. The adjusting wheel set mechanism 2300 can cooperate with the flying mechanism to realize the up-and-down adjustment of the flying mechanism on the pivot rack 2000 to adapt to different users.

As shown in FIG. 7, in order to make users use the flying mechanism easily, two pivot racks 2000 are both provided with flying carriages 2410, which are movably connected with the pivot rack 2000. The two bird carriages 2410 are both provided with flying wheel carriers 2420. Two flying guide wheels 2430 are rotatably connected in the flying wheel carrier 2420, and the flying wheel carrier 2420 is rotatably connected with the flying carriage 2410. One end of the connecting rope 1240 is connected to the flying carrier 2420. The connecting rope 1240 passes through the first pivot wheel 3101, the second pivot wheel 3102, the upper sliding wheel 2322, the third pivot wheel 3103 and the fourth pivot wheel 3104 from the flying wheel carrier 2420, passes through the hole plate fixing mechanism 2200, and then passes through the fixed wheel carrier 1100, and is connected with the counterweight assembly 1200. The connecting rope 1240 is always in a vertical state at the position of the hole plate fixing mechanism 2200, and the vertical line where the connecting rope 1240 is located is collinear with the rotating axis of the pivot rack 2000, so that the user can adjust the opening angle of the pivot rack 2000 according to his own conditions, so as to adjust the use width between the two flying carriages 2410 and achieve more suitable exercise.

Furthermore, the position of the flying carriage 2410 is provided with a grip part 2440 to improve the user's comfort when exercising. The grip part 2440 is connected with the counterweight assembly 1200 through the connecting rope 1240. The flying carriage 2410 is further provided with an adjusting rope 2450. One end of the adjusting rope 2450 is connected with the flying carriage 2410, passes through the crown block 2310 and the movable pulley block 2320 in turn, and the other end is connected with the bottom of the pivot rack 2000.

The flying carriage 2410 includes a carriage rack 2460 slidably connected with the pivot rack 2000, and two rollers are rotatably connected to both sides of the pivot rack 2000 in the carriage rack 2460, wherein one side of the carriage rack 2460 is provided with a handle 2461, and a second spring bolt 2470 is provided on the side of the carriage rack 2460 where the handle 2461 is provided. The pivot rack 2000 is provided with a plurality of transverse preset holes 2462. The second spring pin 2470 can be inserted into the preset hole 2462 for fixation. When the user needs to adjust the height of the flying mechanism, he can first hold the handle 2461 and pull out the second spring pin 2470, then slide the flying carriage 2410 to a proper position through the handle 2461 to be aligned with the preset hole 2462 on the pivot rack 2000, and then allow the second spring pin 2470 to pass through the flying carriage 2410 to be inserted into the preset hole 2462.

As a further illustration, because the preset holes 2462 in the pivot racks 2000 on both sides are horizontally disposed, the flying carriages 2410 at both ends can be ensured to be at the same horizontal position, and because the flying wheel carrier 2420 is rotatably connected with the flying carriage 2410 through the wheel carrier shaft 2421, when the user uses the flying mechanism to exercise, the wheel carrier shaft 2421 will force the flying wheel carrier 2420 to rotate to a proper position due to the pulling of the user. The connecting rope 1240 at the grip part 2440 can transfer traction more smoothly, increase the fit with the flying guide wheel 2430, reduce the fatigue damage of the equipment, and improve the service life of the equipment. At the same time, when the user adjusts the flying carriage 2410 to ascend or descend for a certain distance, the adjusting rope 2450 at the side of the crown block 2310 also ascends or descends for a certain distance, and the adjusting rope 2450 at the side of the movable pulley block 2320 ascends or descends by half. The connecting rope 1240, which is also located on the side of the movable pulley set 2320, also moves up or down by a half distance. Because the pulley is a movable pulley, the connecting rope 1240 will move twice the moving distance of the movable pulley set 2320, thus ensuring that the grip part 2440 always stays at the fixed position of the flying carriage 2410 no matter how much the flying mechanism moves up or down.

Figure 9:
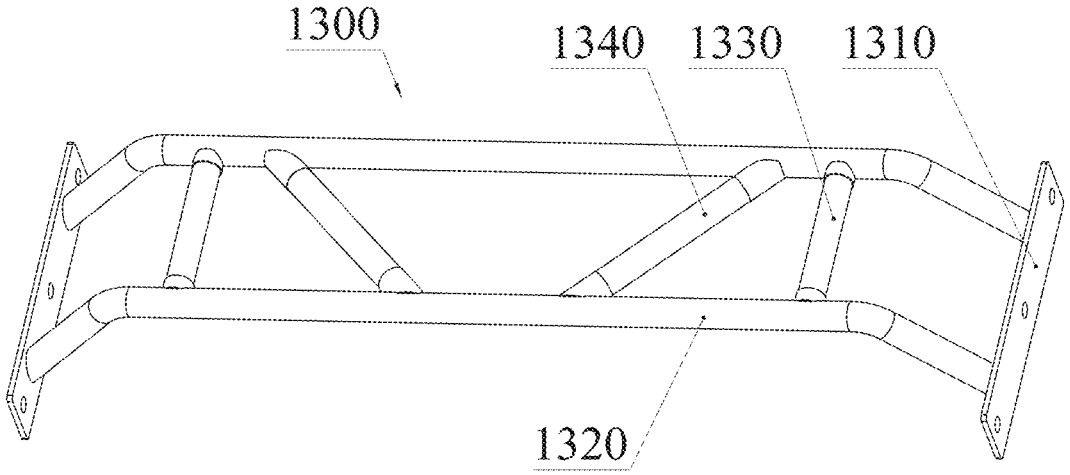
FIG. 9 is a partial schematic view of the pull-up assembly.

As shown in FIG. 9, in order to facilitate the user to do pull-up exercises, a pull-up assembly 1300 is disposed at the upper part of the fixed rack 1000. The pull-up assembly 1300 includes two fixed plates 1310 fixedly connected with the fixed rack 1000, wherein through holes can be uniformly disposed on the fixed plates 1310, two cross beams are disposed at the upper part of the chassis 1400 of the fixed rack 1000, and the pull-up assembly 1300 is erected between the cross beams. The fixed plate 1310 is closely attached to the cross beam, and the pull-up assembly 1300 is firmly connected to the fixed rack 1000 through the matching of the transverse preset hole 2462 on the cross beam and the through hole on the fixed plate 1310. The cross beam has enough length to install the pull-up assembly 1300, so that even if the pivot rack 2000 rotates, it is not necessary to disassemble the pull-up assembly 1300, and users can perform pull-up exercises at any time. Two fixed tubes 1320 are fixedly connected between the two fixed plates 1310, and two vertical rods 1330 and two inclined rods 1340 are fixedly connected between the two fixed tubes 1320. All parts of the pull-up assembly 1300 are firmly connected, and the connection mode can be, but is not limited to, welding, riveting, threaded connection and the like. The vertical rods 1330 and the inclined rods 1340 can not only strengthen the firmness of the pull-up assembly 1300, but also serve as exercise parts for pull-ups.

Figure 8:
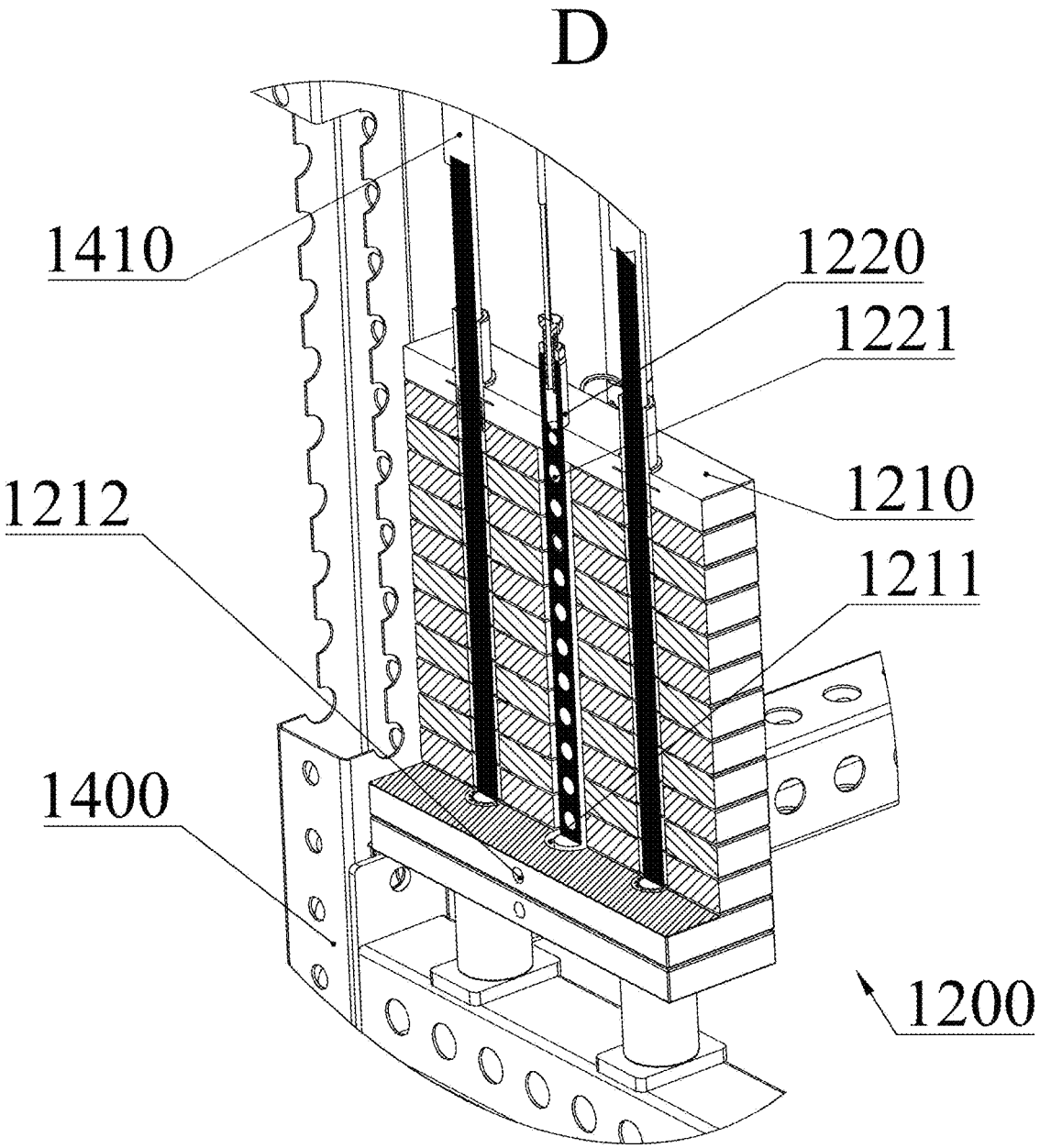
FIG. 8 is a partial sectional view at D in FIG. 6.

As shown in FIG. 8, the counterweight assembly 1200 includes a plurality of weight stacks 1210, and the middle of each weight stack 1210 is provided with a yielding hole 1211 and an adjusting hole 1212. The yielding hole 1211 is disposed at the center of the horizontal plane of the weight stack 1210 and the adjusting hole 1212 is disposed at the center of the lateral surface of the weight stack 1210. Both the yielding hole 1211 and the adjusting hole 1212 penetrate through the weight stacks 1210 and intersect at the center of the weight stacks 1210. One end of the connecting rope 1240 close to the counterweight assembly 1200 is connected with an adjusting rod 1220, which is inserted into the yielding hole 1211. The adjusting rod 1220 is provided with a plurality of matching holes 1221. When the adjusting rod 1220 is inserted into the yielding hole 1211, the axes of the matching holes 1221 are respectively aligned with the axes of the corresponding adjusting holes 1212. Adjusting pins 1230 are inserted into the adjusting holes 1212. The adjusting pins 1230 can pass through both the adjusting holes 1212 and the matching holes 1221, and the adjusting rod 1220 can lift all the weight stacks 1210 at the positions where the adjusting pins 1230 are inserted into the adjusting hole 1212 and those at the positions above, thus achieving the function of adjusting the weight.

As shown in FIG. 6, the fixed rack 1000 includes a chassis 1400, a counterweight slidable bar 1410 and a storage plate 1420 disposed on the chassis 1400. The counterweight assembly 1200 is slidably connected with the counterweight slidable bar 1410, and the counterweight slidable bar 1410 is parallel to the connecting rope 1240 above the adjusting rod 1220. The storage plate 1420 is provided with a plurality of hooks 1421, which can be used to hang various exercise parts.

The foldable small flying and squat rack provided by the present disclosure takes into account the common exercise function of both a flying exercise machine and a comprehensive squat rack, and includes a pivot rack 2000 which can rotate relative to the fixed rack 1000. The pivot rack 2000 can be adjusted in different working states according to the needs of users, so that it is always in the desired state of users. At the same time, when not in use, the pivot rack 2000 can be adjusted to a storage state to reduce its occupied volume. The fixed rack 1000 is also provided with optional weight stacks 1210. Optional weight stacks 1210 are provided by a designed connecting rope 1240, so that the flying machine is adapted to users with different arm lengths by a designed adjusting rope 2450. At the same time, the pull-up assembly 1300 is fixed above the fixed rack 1000 to facilitate customers to exercise for different parts. Moreover, the whole frame of the foldable small flying and squat rack is provided with preset holes 2462, so that the height of the flying mechanism can be adjusted to adapt to different users.

The technical means disclosed in the solution of the present disclosure are not limited to the technical means disclosed in the above embodiments, but also include the technical solution composed of any combination of the above technical features. It should be appreciated that for those skilled in the art, several improvements and embellishments can be made without departing from the principle of the present disclosure, and these improvements and embellishments shall be regarded as falling within the protection scope of the present disclosure.

What is claimed is:

1. A foldable small flying and squat rack, comprising a fixed rack, pivot racks and pulley blocks disposed on the fixed rack and the pivot racks, wherein the pivot racks comprise two pivot racks that are respectively rotatably connected to the fixed rack; and a counterweight assembly connected with the fixed rack in a sliding manner, wherein an upper part of the counterweight assembly is connected with a connecting rope-, which winds around the pulley blocks on the fixed rack and the pivot racks in turn to extend out;

wherein each of the two pivot racks is provided with a pivot wheel set mechanism, and a connecting sheet is fixedly disposed on the pivot wheel set mechanism; and a rotary inner cylinder is fixedly disposed on the connecting sheet, and the pivot racks are rotatably connected with the fixed rack through the rotary inner cylinder; and the connecting rope passes through the rotary inner cylinder, and a pulley block of the pulley blocks comprises a first deflecting pulley and a second deflecting pulley, which are respectively disposed above and below the rotary inner cylinder; and wherein, a part of the connecting rope located at the position of a rotating axis of the rotary inner cylinder is always in a vertical state, and a tangent point of the connecting rope winding out of the first deflecting pulley and into the second deflecting pulley is located on the axis of the rotary inner cylinder, so as to avoid the connecting rope from being dragged by the rotation of a pivot rack of the pivot racks.

2. The foldable small flying and squat rack according to claim 1, wherein the pivot wheel set mechanism comprises a pivot wheel rack fixedly connected to the top of the pivot rack, and a pulley block of the pulley blocks comprises a first pivot wheel, a second pivot wheel, a third pivot wheel and a fourth pivot wheel rotatably connected to the pivot wheel rack;

the first pivot wheel is located on a side of the pivot rack far from the fixed rack, and the second pivot wheel, the third pivot wheel and the fourth pivot wheel are located on a side of the pivot rack close to the fixed rack; and the connecting rope passes through the fourth pivot wheel, the third pivot wheel, the second pivot wheel and the first pivot wheel in turn; and wherein the fourth pivot wheel is disposed below the rotary inner cylinder to constitute the second deflecting pulley.

3. The foldable small flying and squat rack according to claim 2, wherein fixed wheel carriers are disposed at both sides of an upper part of the fixed rack, and each fixed wheel carrier is rotatably connected with two fixed wheels, wherein one of the fixed wheels is disposed above the rotary inner cylinder to constitute the first deflecting pulley.

4. The foldable small flying and squat rack according to claim 3, wherein a hole plate fixing mechanism for limiting the rotation of the pivot racks is disposed between the two pivot racks and the fixed rack, and a first spring bolt is further disposed on the connecting sheet; and the hole plate fixing mechanism comprises an upper rotary sleeve fixedly connected with the upper part of the fixed rack, and the rotary inner cylinder is rotatably connected with the upper rotary sleeve; and the upper rotary sleeve is fixedly connected with an upper fixed hole plate, the upper fixed hole plate is provided with a plurality of upper insertion holes, and the first spring bolt is inserted into an upper insertion hole of the plurality of upper insertion holes to fix the position of the connecting sheet relative to the upper fixed hole plate; the axes of the upper rotary sleeve and the rotary inner cylinder are both vertical to the ground; and a plurality of upper pivot bearings are provided between the upper rotary sleeve and the rotary inner cylinder, an interior of the rotary inner cylinder is hollow, and the connecting rope passes through the interior of the rotary inner cylinder.

5. The foldable small flying and squat rack according to claim 4, wherein the hole plate fixing mechanism further comprises a lower rotary sleeve fixedly connected with a lower part of the fixed rack, and a rotary column is disposed below the pivot rack; and a plurality of lower pivot bearings are provided between the lower rotary sleeve and the rotary column, and rotating shafts of the upper rotary sleeve and the lower rotary sleeve coincide and are vertical to the ground.

6. The foldable small flying and squat rack according to claim 5, wherein a lower fixed hole plate is fixedly disposed below the lower rotary sleeve, and a plurality of lower insertion holes are disposed on the lower fixed hole plate; and a positioning hole is disposed on the pivot rack, a fixed pin is inserted into a lower insertion hole of the plurality of lower insertion holes, and the fixed pin can be inserted into the positioning hole so as to fix the position of the lower fixed hole plate relative to the pivot rack; and a top of the lower rotary sleeve is provided with a circular cover plate that is fixedly connected with the rotary column by bolts.

7. The foldable small flying and squat rack according to claim 6, wherein each of the two pivot racks is provided with an adjusting wheel set mechanism, and the adjusting wheel set mechanism comprises a crown block and a movable pulley set; and the crown block is rotatably connected with a bottom of the pivot rack, and the movable pulley set is located in the middle of the pivot rack; and the movable pulley set comprises a sliding rack and an upper movable pulley and a lower movable pulley which are rotatably connected with the sliding rack.

8. The foldable small flying and squat rack according to claim 7, wherein the two pivot racks are both provided with flying carriages, and both the two flying carriages are movably connected with the pivot racks; and both the two flying carriages are provided with flying wheel carriers, and two flying guide wheels are rotatably connected in each of the flying wheel carrier; and the flying wheel carrier is rotatably connected with the flying carriage, and one end of the connecting rope is connected to the flying wheel carrier.

9. The foldable small flying and squat rack according to claim 1, wherein a pull-up assembly is disposed at an upper position of the fixed rack, and the pull-up assembly can be fixedly connected with the fixed rack; and the pull-up assembly comprises two fixed plates fixedly connected with the fixed rack, two fixed tubes are fixedly connected between the two fixed plates, and two vertical rods and two inclined rods are fixedly connected between the two fixed tubes.

10. The foldable small flying and squat rack according to claim 1, wherein the counterweight assembly comprises a plurality of weight stacks, and the middle of each weight stack is provided with a yielding hole and an adjusting hole; and an end of the connecting rope close to the counterweight assembly is connected with an adjusting rod, and the adjusting rod is inserted into the yielding hole; and a plurality of matching holes are provided on the adjusting rod, an adjusting pin is inserted into the adjusting hole, and the adjusting pin can pass through both the adjusting hole and the matching holes.

11. The foldable small flying and squat rack according to claim 1, wherein the fixed rack comprises a chassis, a counterweight slidable bar and a storage plate disposed on the chassis, the counterweight assembly is slidably connected with the counterweight slidable bar, and a plurality of hooks are arranged on the storage plate.

12. A foldable small flying and squat rack, comprising a fixed rack, pivot racks and pulley blocks disposed on the fixed rack and the pivot racks, wherein the pivot racks comprise two pivot racks that are respectively connected to the fixed rack; and a counterweight assembly, connected with the fixed rack in a sliding manner, and an upper part of the counterweight assembly is connected with a connecting rope, which winds around the pulley blocks on the fixed rack and the pivot racks in turn to extend out;

wherein each of the two pivot racks is provided with a pivot wheel set mechanism, and a connecting sheet is fixedly disposed on the pivot wheel set mechanism; and a rotary inner cylinder is fixedly disposed on the connecting sheet, the two pivot racks are rotatably connected with the fixed rack respectively through the rotary inner cylinder and rotate to any angle within a limited angle range; and the connecting rope passes through the rotary inner cylinder, and a pulley block of the pulley blocks comprises a first deflecting pulley and a second deflecting pulley, which are respectively disposed above and below the rotary inner cylinder; and wherein, a part of the connecting rope located at the position of a rotating axis of the rotary inner cylinder is always in a vertical state, and a tangent point of the connecting rope winding out of the first deflecting pulley and into the second deflecting pulley is located on the axis of the rotary inner cylinder, so as to avoid the connecting rope from being dragged by the rotation of a pivot rack of the pivot racks.

13. The foldable small flying and squat rack according to claim 12, wherein the pivot wheel set mechanism comprises a pivot wheel rack fixedly connected to the top of the pivot rack, and a pulley block of the pulley blocks comprises a first pivot wheel, a second pivot wheel, a third pivot wheel and a fourth pivot wheel rotatably connected to the pivot wheel rack;

the first pivot wheel is located on a side of the pivot rack far from the fixed rack, and the second pivot wheel, the third pivot wheel and the fourth pivot wheel are located on a side of the pivot rack close to the fixed rack; and the connecting rope passes through the fourth pivot wheel, the third pivot wheel, the second pivot wheel and the first pivot wheel in turn; and wherein the fourth pivot wheel is disposed below the rotary inner cylinder to constitute the second deflecting pulley.

14. The foldable small flying and squat rack according to claim 13, wherein fixed wheel carriers are disposed at both sides of an upper part of the fixed rack, and each fixed wheel carrier is rotatably connected with two fixed wheels, wherein one of the fixed wheels is disposed above the rotary inner cylinder to constitute the first deflecting pulley.

15. The foldable small flying and squat rack according to claim 14, wherein a hole plate fixing mechanism for limiting the rotation of the pivot racks is disposed between the two pivot racks and the fixed rack, and a first spring bolt is further disposed on the connecting sheet; and the hole plate fixing mechanism comprises an upper rotary sleeve fixedly connected with the upper part of the fixed rack, and the rotary inner cylinder is rotatably connected with the upper rotary sleeve; and the upper rotary sleeve is fixedly connected with an upper fixed hole plate, the upper fixed hole plate is provided with a plurality of upper insertion holes, and the first spring bolt is inserted into an upper insertion hole of the plurality of upper insertion holes to fix the position of the connecting sheet relative to the upper fixed hole plate; the axes of the upper rotary sleeve and the rotary inner cylinder are both vertical to the ground; and a plurality of upper pivot bearings are provided between the upper rotary sleeve and the rotary inner cylinder, an interior of the rotary inner cylinder is hollow, and the connecting rope passes through the interior of the rotary inner cylinder.

16. The foldable small flying and squat rack according to claim 15, wherein each of the two pivot racks is provided with an adjusting wheel set mechanism, and the adjusting wheel set mechanism comprises a crown block and a movable pulley set; and the crown block is rotatably connected with a bottom of the pivot rack, and the movable pulley set is located in the middle of the pivot rack; and the movable pulley set comprises a sliding rack and an upper movable pulley and a lower movable pulley which are rotatably connected with the sliding rack.

17. The foldable small flying and squat rack according to claim 12, wherein a pull-up assembly is disposed at an upper position of the fixed rack, and the pull-up assembly can be fixedly connected with the fixed rack; and the pull-up assembly comprises two fixed plates fixedly connected with the fixed rack, two fixed tubes are fixedly connected between the two fixed plates, and two vertical rods and two inclined rods are fixedly connected between the two fixed tubes.

18. A foldable small flying and squat rack, comprising a fixed rack, pivot racks and pulley blocks disposed on the fixed rack and the pivot racks, wherein the pivot racks comprise two pivot racks that are respectively connected to the fixed rack; and a counterweight assembly, which is connected with the fixed rack in a sliding manner, and an upper part of the counterweight assembly is connected with a connecting rope, which winds around the pulley blocks on the fixed rack and the pivot racks in turn to extend out;

wherein each of the two pivot racks is provided with a pivot wheel set mechanism, and a connecting sheet is fixedly disposed on the pivot wheel set mechanism; and a rotary inner cylinder is fixedly disposed on the connecting sheet, the two pivot racks are rotatably connected with the fixed rack respectively through the rotary inner cylinder; and a pulley block of the pulley blocks comprises a first deflecting pulley and a second deflecting pulley; the first deflecting pulley is disposed above the rotary inner cylinder, and the second deflecting pulley is disposed below the rotary inner cylinder;

wherein, the connecting rope winds out of the first deflecting pulley, passes through the rotary inner cylinder and winds into the second deflecting pulley; and the connecting rope in the rotary inner cylinder is always kept in a vertical state, so as to avoid the connecting rope from being dragged by the rotation of the pivot rack.

19. The foldable small flying and squat rack according to claim 18, wherein a tangent point of the connecting rope winding out of the first deflecting pulley and winding into the second deflecting pulley is on an axis of the rotary inner cylinder.

20. The foldable small flying and squat rack according to claim 18, wherein the connecting rope between the first deflecting pulley and the second deflecting pulley is parallel or collinear with the axis of the rotary inner cylinder.

* * * * *